US006149156A

United States Patent [19]

Feola

[11] Patent Number: 6,149,156

[45] Date of Patent: Nov. 21, 2000

[54] MULTIPLE ROUND CARD GAME OF CHANCE

[76] Inventor: John Feola, 42 Irving St., Medford, Mass. 02155

[21] Appl. No.: 09/312,562

[22] Filed: May 14, 1999

[51] Int. Cl.[7] ..... A63F 1/00

[52] U.S. Cl. ..... 273/292; 273/269

[58] Field of Search ..... 273/269, 292

[56] References Cited

U.S. PATENT DOCUMENTS

| | | | |
|---|---|---|---|
| 1,616,884 | 2/1927 | Bosley et al. | 273/236 |
| 4,560,171 | 12/1985 | Anthony . | |
| 5,918,884 | 7/1999 | DiMuro | 273/292 |
| 5,957,774 | 9/1999 | Holmes et al. | 273/292 X |

OTHER PUBLICATIONS

Rules to Keno.

*Primary Examiner*—John A. Ricci
*Attorney, Agent, or Firm*—Morse, Altman & Martin

[57] ABSTRACT

A card game having multiple rounds in which a player chooses which rounds to play and a number of locations on a displayed grid of hidden, randomly-selected cards for each chosen round. Each round has rules different from the other rounds. Cards later revealed at the chosen locations and at randomly selected locations are used to play the chosen rounds. Payouts are determined by the number of player-chosen locations that matches the number of randomly selected locations and/or by the hand formed by the randomly selected cards revealed in the player-chosen locations.

27 Claims, 9 Drawing Sheets

COMBINATION GAME

$ JACKPOT AMOUNT

| Guaranteed Five | |
|---|---|
| Royal Flush | $20,000 |
| Straight Flush | 2,000 |
| Four of a Kind | 100 |
| Full House | 50 |
| Flush | 25 |
| Straight | 15 |
| Three of a Kind | 10 |
| Two Pair | 4 |
| One Pair | 1 |

| Five Card Match | |
|---|---|
| Royal Flush | % |
| Straight Flush | % |
| Four of a Kind | % |
| Full House | % |
| Flush | % |
| Straight | xx |
| Three of a Kind | xx |
| Two Pair | xx |
| One Pair | xx |

| Seven Card Match | |
|---|---|
| Royal Flush | % |
| Straight Flush | % |
| Four of a Kind | % |
| Full House | % |
| Flush | % |
| Straight | xx |
| Three of a Kind | xx |
| Two Pair | xx |
| One Pair | xx |

| Guaranteed Seven | |
|---|---|
| Royal Flush | $2,500 |
| Straight Flush | 300 |
| Four of a Kind | 100 |
| Full House | 10 |
| Flush | 5 |
| Straight | 3 |
| Three of a Kind | 2 |
| Two Pair | 1 |
| One Pair | 0 |

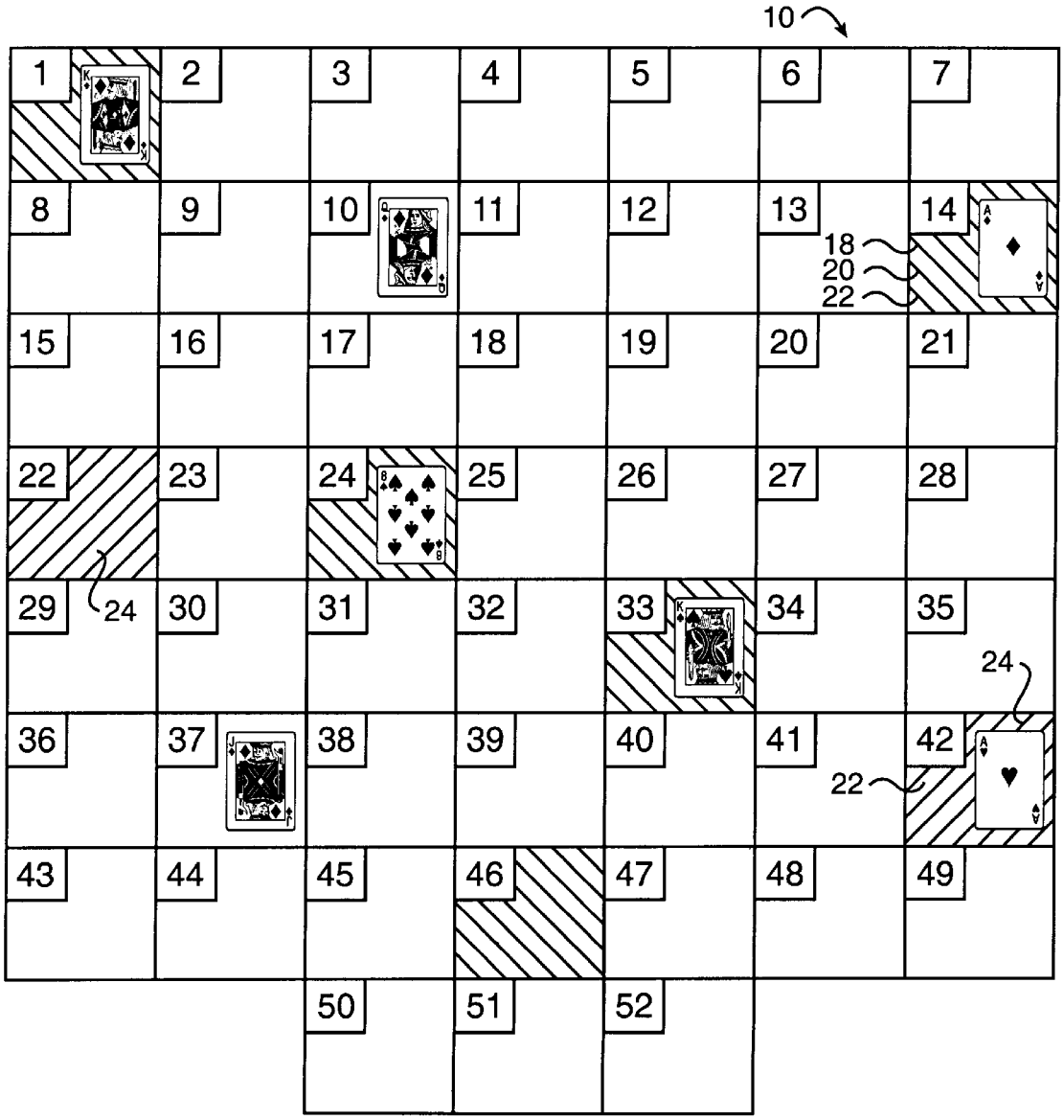

FIG. 3

COMBINATION GAME

$ JACKPOT AMOUNT

| Guaranteed Five | |
|---|---|
| Royal Flush | $20,000 |
| Straight Flush | 2,000 |
| Four of a Kind | 100 |
| Full House | 50 |
| Flush | 25 |
| Straight | 15 |
| Three of a Kind | 10 |
| Two Pair | 4 |
| One Pair | 1 |

| Five Card Match | |
|---|---|
| Royal Flush | % |
| Straight Flush | % |
| Four of a Kind | % |
| Full House | % |
| Flush | % |
| Straight | xx |
| Three of a Kind | xx |
| Two Pair | xx |
| One Pair | xx |

| Seven Card Match | |
|---|---|
| Royal Flush | % |
| Straight Flush | % |
| Four of a Kind | % |
| Full House | % |
| Flush | % |
| Straight | xx |
| Three of a Kind | xx |
| Two Pair | xx |
| One Pair | xx |

| Guaranteed Seven | |
|---|---|
| Royal Flush | $2,500 |
| Straight Flush | 300 |
| Four of a Kind | 100 |
| Full House | 10 |
| Flush | 5 |
| Straight | 3 |
| Three of a Kind | 2 |
| Two Pair | 1 |
| One Pair | 0 |

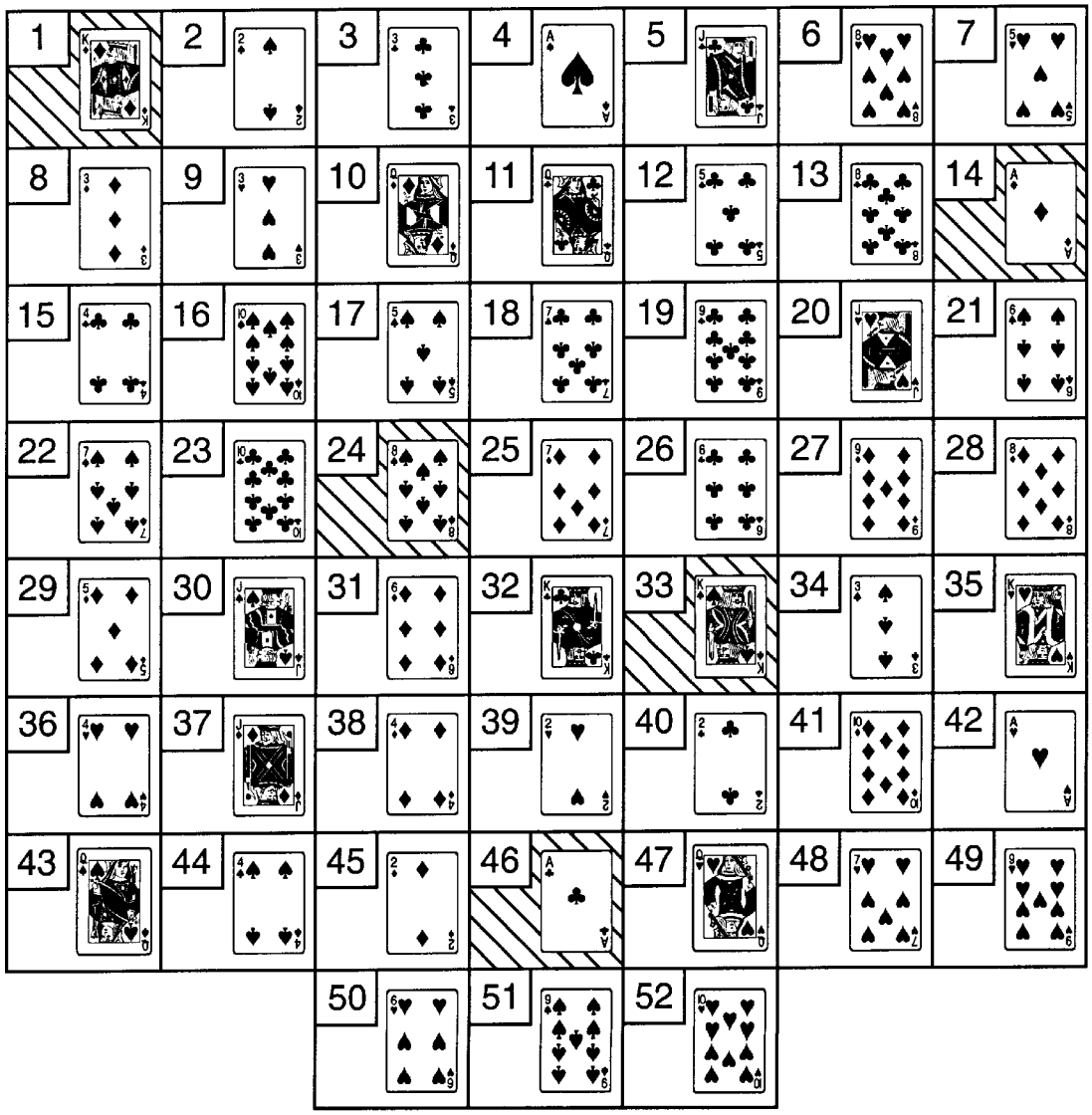

FIG. 4

COMBINATION GAME

$ JACKPOT AMOUNT

| Guaranteed Five | |
|---|---|
| Royal Flush | $20,000 |
| Straight Flush | 2,000 |
| Four of a Kind | 100 |
| Full House | 50 |
| Flush | 25 |
| Straight | 15 |
| Three of a Kind | 10 |
| Two Pair | 4 |
| One Pair | 1 |

| Five Card Match | |
|---|---|
| Royal Flush | % |
| Straight Flush | % |
| Four of a Kind | % |
| Full House | % |
| Flush | % |
| Straight | xx |
| Three of a Kind | xx |
| Two Pair | xx |
| One Pair | xx |

| Seven Card Match | |
|---|---|
| Royal Flush | % |
| Straight Flush | % |
| Four of a Kind | % |
| Full House | % |
| Flush | % |
| Straight | xx |
| Three of a Kind | xx |
| Two Pair | xx |
| One Pair | xx |

| Guaranteed Seven | |
|---|---|
| Royal Flush | $2,500 |
| Straight Flush | 300 |
| Four of a Kind | 100 |
| Full House | 10 |
| Flush | 5 |
| Straight | 3 |
| Three of a Kind | 2 |
| Two Pair | 1 |
| One Pair | 0 |

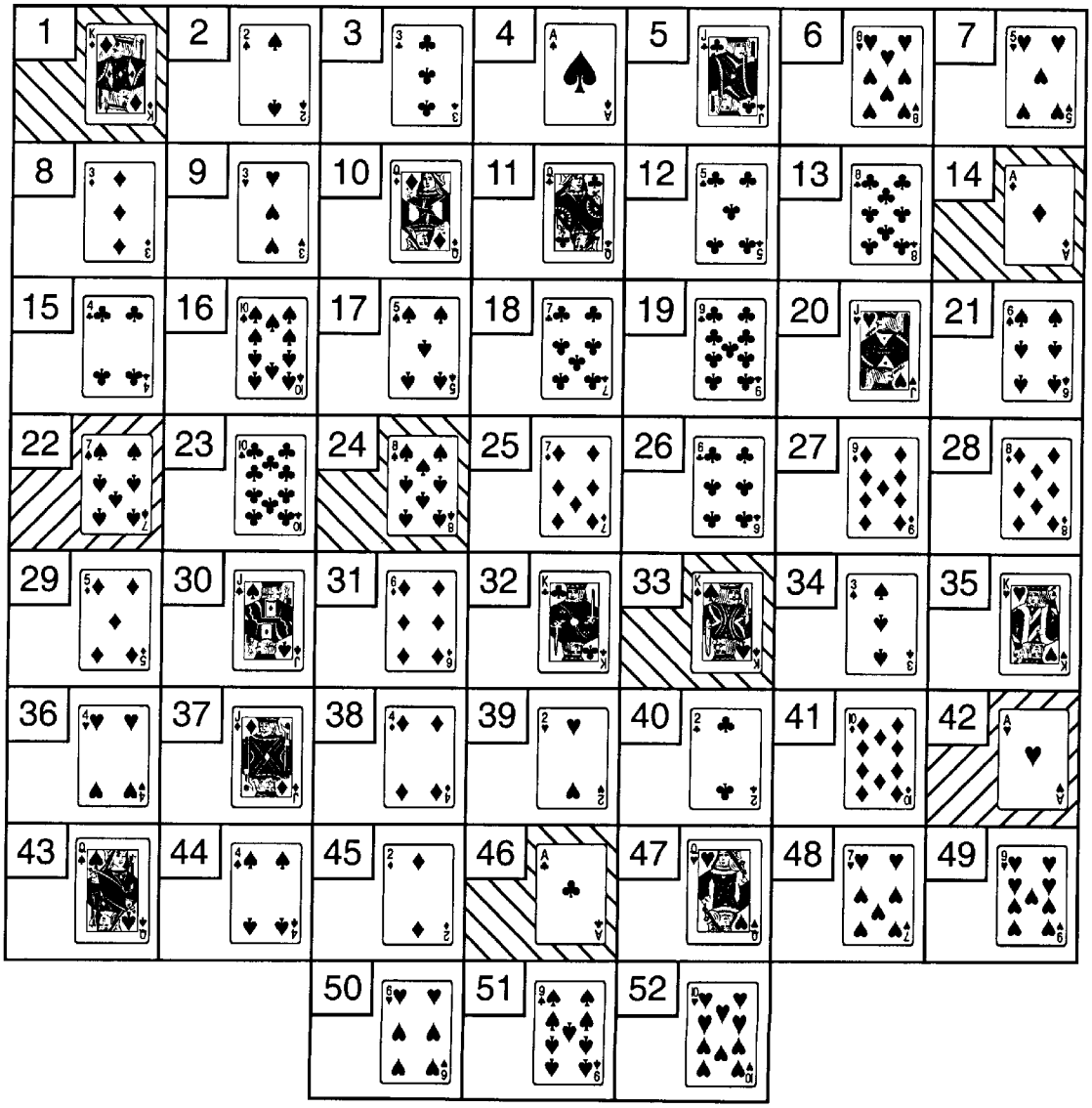

FIG. 5

COMBINATION GAME

| Five Location Match ROUND # 01000 | | 5-of-7 Location Match ROUND # 01000 | | Guaranteed Five ROUND # 01000 | | Guaranteed Seven ROUND # 01000 | |
|---|---|---|---|---|---|---|---|
| $ | Select "5" Numbers | $ | Select "7" Numbers | $ | Select "5" Numbers | $ | Select "7" Numbers |
| 1 | 4 8 12 16 20 | 1 | 4 8 12 16 20 31 42 | 5 | 4 8 12 16 20 | 1 | 4 8 12 16 20 31 42 |
| 1 | 3 7 25 30 41 | 1 | 3 7 25 30 41 49 52 | 10 | 3 7 25 30 41 | 4 | 3 7 25 30 41 49 52 |
| 1 | 2 14 29 44 52 | 1 | 7 9 13 17 27 41 46 | 5 | 2 5 9 17 20 | 10 | 7 8 9 24 31 46 41 |
| 1 | 8 18 28 38 48 | 1 | 2 5 11 21 34 39 45 | 1 | 16 22 32 45 52 | 2 | 6 8 9 15 17 21 40 |
| 1 | 9 13 22 25 47 | 1 | 4 9 12 26 28 31 43 | 2 | 7 12 17 33 50 | 5 | 2 6 7 12 13 18 24 |
| 2 | 1 7 10 15 20 | 2 | 1 4 10 18 25 30 52 | 3 | 13 14 22 41 51 | 3 | 1 4 8 17 35 42 52 |

FIG. 9

42

MULTIPLE ROUND CARD GAME OF CHANCE

BACKGROUND OF THE INVENTION

1. Field of the Invention

The present invention relates to games of chance, more specifically, to a card game that allows a player to play more than one individual card game in a progression.

2. The Prior Art

There are a number of non-casino games of chance where winners and losers are determined immediately or almost immediately after the wager is made. Such games include scratch tickets, pull-tab tickets, and keno. With scratch and pull-tab tickets, the player buys the ticket and either scratches spots or opens tabs according to the instructions for the ticket. The player knows immediately whether she is a winner or not. However, the player has little choice in what locations to scratch or open. For example, if the game being played is poker-based, the player will not be able to choose from all of the possible 52 cards because there is limited space on the ticket. This means that tickets are predetermined to be winners or losers.

Probability tickets are different in that every ticket has the potential to be a winner. There are a number of spots to scratch and the player chooses some of them, as indicated by the rules. However, the player still does not have a choice of all 52 cards.

In keno, the player chooses numbers up to a maximum, for example, choosing 10 numbers between 1 and 80. The more numbers that are matched, the greater the payout. Variations include allowing the player to select a variable number of numbers, for example, between 1 and 15 number. When run by a state, the winning numbers are drawn periodically during the day, such as every 15 minutes, and players who have chosen their numbers prior to the drawing participate. Players find out quickly whether they win or lose and then the cycle starts over again. The excitement of playing the game is short-lived and is not drawn out over an extended period.

SUMMARY OF THE INVENTION

An object of the present invention is to provide a game for wagering that has more than one round of different card games.

Another object is to provide a card game for wagering in which winners are determined at the end of each round of the game so that the excitement of the game is drawn out over an extended period.

A further object is to provide a card game for wagering that includes more than one round that can be wagered on individually.

A still further object is to provide a card game for wagering in which there is the potential to win every game.

The basis of the game of the present invention is that a player chooses a number of locations on a grid of hidden, randomly-selected cards, and uses the cards later revealed at these chosen locations and at other randomly selected locations to play a number of different individual games, or rounds, where a wager is placed on each round. A game has at least two rounds, and a player may play one or more, but there is no requirement that the player play an earlier round to play a later round. Having multiple rounds provides more excitement since, even if a player loses earlier rounds, she can still win later rounds, which will typically have better odds.

In some rounds, the number of player-chosen locations that matches the number of randomly selected locations determines the payout, and in some rounds, the hand formed by the randomly selected cards revealed in the player-chosen locations determines the payout. The payouts are determined by the odds of getting a particular hand. The payouts may be determined in one of a several ways, including a set multiple of the wager, a percentage of a jackpot that is a percentage of wagers by all of the players for that game, and/or a percentage of a cumulative jackpot that is an accumulation of some percentage of the wagers from the previous games.

All of the rounds are played using a displayed grid of having the same number of locations as the number of cards being used, typically a standard 52-card deck of playing cards. Each location is uniquely numbered. During the game, the player chooses which rounds and locations to play. How the player chooses the rounds and locations and how the grid is displayed depends upon the medium on which the game. is played. Having the ability to select from all cards in play means that the player has the potential to win every game, which is unlike other games that preselect a subset of the total number of possible cards for the player to choose from.

One embodiment of the game includes four rounds: (1) a five locations match game, (2) a seven location match game, (3) a guaranteed five card hand game, and (4) a guaranteed seven card hand game. The following describes each game as if it is played by itself. The goal of the five location match game is for the player to choose the five locations on the grid that will be selected and revealed. The player chooses five locations and the controller randomly selects five locations and cards that will be revealed in those locations. Payouts are made based on the number of matched locations, which are those locations that are correctly chosen, and/or payouts are made based on the hand formed from the cards in the matched locations. The seven location match game is similar to the five location match game, except that the player chooses seven locations and the controller selects seven locations.

The goal of the guaranteed five card hand game is for the player to choose five cards to form a hand that is listed on the payout schedule. The player chooses five locations and the controller randomly selects and reveals cards for at least those five locations. A hand is formed from the cards revealed in the chosen locations and payouts are based on whether or not the hand is listed in the payout schedule. In one embodiment, the player must use the five cards chosen. In another embodiment, the player is allowed to reject chosen locations and choose others to total five locations. The guaranteed seven card hand game is very similar to the guaranteed five card hand game, except that the player chooses seven locations instead of five.

In one embodiment of the game of the present invention, the above-described individual games are combined as rounds into a single combination game. First, the player chooses which rounds she will participate in, which locations to play for each round, and the amount to wager for each chosen round. Then the five location match game is initiated by revealing five randomly selected locations and the randomly selected cards for those locations. Matched locations and the hands formed from the matched locations are determined. Payouts are either made at this time or held until the end of the combination game. Next, the seven location match game is initiated by randomly selecting and revealing two additional cards. Matched locations and the hands formed from the matched locations are determined. The two additional cards plus the five selected cards from the five location match game are the seven cards used to determine matched locations.

Next, the guaranteed five card hand game is initiated by revealing the cards for the first five chosen locations, which are carried over from the first round. Finally, the guaranteed seven card hand game is played. The cards selected and revealed in the previous rounds carry over to this round. Then payouts that have not yet been made are made.

In one embodiment of the combination game, the appropriate cards are revealed at the beginning of each round, in progression as each game is played. In another embodiment, all of the cards are revealed at the same time. The first embodiment provides more suspense as the game is extended over a longer period of time. The second embodiment permits more games to be played in a given period of time.

The present invention contemplates that the game may be played on a variety of media, including scratch or pull-tab tickets and electronic media, such as public and private video systems and stand-alone machines. With scratch tickets, the cards are randomly selected prior to printing, and the player makes her choices by scratching the chosen locations. In public video systems, players typically make their choices by marking slips of paper or by keys or touch screens at a location remote from the controller. The grid is displayed on a public video screen or matrix of video screens visible to the players at the remote location. With private standalone machines, the grid is displayed on the player's private video screen and the player's choices are made using keys or a touch screen.

Other objects of the present invention will become apparent in light of the following drawings and detailed description of the invention.

BRIEF DESCRIPTION OF THE DRAWINGS

For a fuller understanding of the nature and object of the present invention, reference is made to the accompanying drawings, wherein:

FIG. 3 is an example grid of the seven location match game of the second round;

FIG. 4 is an example grid of the guaranteed five card hand game;

FIG. 5 is an example grid of the guaranteed seven card hand game;

FIG. 9 is an example of another slip for choosing individual games and grid locations.

DETAILED DESCRIPTION

Figure 1:
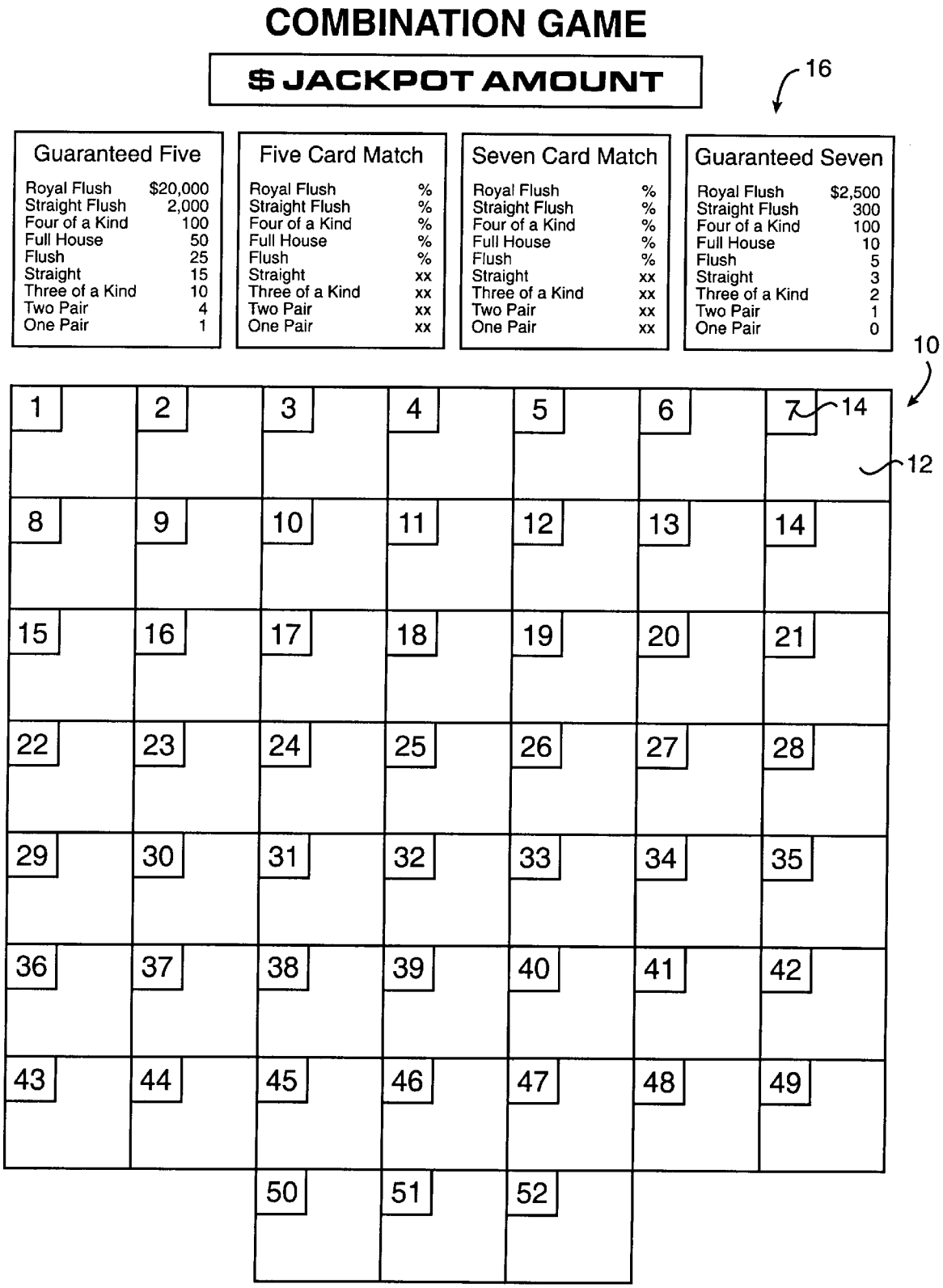
FIG. 1 is a drawing of an example grid of the present invention.

The card game of the present invention provides a game based on a card game where only minimal knowledge of the rules of the underlying card game is necessary to play. The game is played with a set of basic rules and includes a number of optional enhancements. The basis of the game is that a player chooses a number of locations on a grid of hidden cards, and uses the cards later revealed at these chosen locations to play a number of different individual games, or rounds, where a wager is placed on each round.

The term "card" is used in the present application to indicate a playing card or any facsimile thereof. For example, a card can be a paper playing card, an image of a card on a video display, or an image of a card on a scratch ticket. Any representation of a card is contemplated.

A game has at least two rounds. A player may play one or more rounds. There is no requirement that the player must play an earlier round in order to play a later round. For example, the player may play round three without having played round one or two. In the preferred embodiment, the game has four rounds. The first round is a five location match game, the second round is a seven location match game, the third round is a guaranteed five card hand game, and the fourth round is a guaranteed seven card hand game. This is but one way in which the individual games are ordered. The present invention contemplates that the individual games may be in any order. The rules of each individual game are described below, as if the individual game is played as an independent game, followed by how the individual games are combined to form the combination game.

As described below, some payouts are determined by poker hand rankings. The typical poker hand has five or seven cards, as in five card draw or five or seven card stud. However, many kinds of poker-type games can be used with the present invention, the commonality between the games being that the payouts are determined using poker rankings. For example, the hand can be as simple as a single card ("high-card"). Or the hand may be a shortened version where the hand has three cards. Or the hand may be more complex than a standard poker hand, where the hand has more then five cards and the best five cards are used to determine the payout. 7-card stud is an example of the latter, however, a game may be chosen that uses more than seven cards. Finally, the hand may have more than five cards, where any subset of the cards may be used to determine the payout.

The use of standard poker rankings to determine the payouts is merely a convenience. It is used primarily because most people know the rankings and know that it is more difficult to get a straight than to get a pair. However, other card combinations are contemplated for determining payouts, for example, a hand of all even numbered cards or a hand with at least one card from each suit. It is also contemplated that Jokers and/or wild cards may be used. It is also contemplated that games other than poker may be played. One example is a game where the sum of the cards must be less than or greater than a certain number to win. It is also contemplated that decks of cards other than the standard 52-card poker deck may be used, for example, a deck of cards of other than 52 cards and/or with different symbols. Unless otherwise indicated, the remainder of the specification assumes that the games are based upon poker hands.

The amount of payouts is typically determined by the odds of getting a particular hand. There are several ways to determine how much is paid out for a particular hand. In one, the player receives a set multiple of the amount that the player originally wagered. For example, if a player gets a full house, she receives 50 times the amount that she wagered. In another method, the player receives a percentage of a jackpot that is a percentage of wagers by all of the players for that game and/or round. For example, if a player gets a straight flush, she received 40% of the jackpot. The third method is similar to the second, except that the percentage is taken from a cumulative jackpot, which an accumulation of some percentage of the wagers from the previous games. Finally, non-monetary winnings are possible, such as toys, gifts, or coupons. Each game may use only one method or various combinations of methods.

All of the rounds are played using a displayed grid 10 of 52 locations, representing the number of cards in a standard 52-card deck of playing cards, as shown in FIG. 1. Each location 12 is denoted by a unique symbol 14, for example the numerals 1–52. Alternatively, the game can be played with larger grids representing multiples of 52-card decks, or, as indicated above, decks other than the standard 52-card poker deck. In addition to the grid 10 itself, there may be textual information 16 displayed, such as the payout schedule for each round, the rules for each round and the game, the odds for each round, etc.

The individual games and the combination game have two types of actors, the player and the controller. The player is the person wagering on the outcome of the game and makes choices that influence that outcome. The terms "choose", "chosen", and "choice" are used in the present specification to refer to player actions and results. The controller is the entity, typically a computer, that makes random selections to which the players choices are compared. The terms "select" and "selections" are used in the present specification to refer to game controller actions and results.

Prior to or during the game, the player chooses which rounds and grid locations to play. How the player chooses the rounds and locations depends upon the medium on which the game is played, and are described in detail below. All forms of media are contemplated, including public video and private video on local or wide-area networks, and standalone machines.

Five Location Match

The basic goal of the five location match game is for the player to choose the five locations on the 52-location grid that will be selected and revealed. The five location match game begins with the player placing a wager and then choosing the five locations on the grid that she believes will have a card revealed. Then the controller randomly selects and reveals five locations on the grid and the cards that will appear in those locations. The random selection can occur at any time prior to the selected locations being revealed, including prior to the time the player makes her locations choices. Payouts are made based on the number of matched locations, which are those locations that are correctly chosen, and/or payouts are made based on how the hand formed from the cards in the matched locations compares to a payout schedule. For example, if the game is poker, the payout schedule may indicate that the player will receive a payout for having a full house. Typically, a minimum of two matched locations are needed to participate in the poker hand. Alternatively, a single card may participate in the poker hand. Other games may have different minimum numbers of cards needed to participate in this phase of the game.

Seven Location Match

The seven location match game is very similar to the five location match game. The difference is that the player chooses seven locations, rather than five, on the grid that she believes will have a card revealed in this round. Then the controller randomly selects and reveals seven locations on the grid and the cards that will appear in those locations. Alternatively, the player chooses five locations and the controller selects and reveals seven locations, or the player chooses seven locations and the controller selects and reveals five locations. As with the five location match game, the random selection can occur at any time prior to the selected locations being revealed, including prior to the time the player makes her locations choices. Payouts are made based on the number of matched locations, and/or payouts are made based on how the hand formed from the cards in the matched locations compares to a payout schedule. For example, if the game is poker, the best five cards may be used to form a hand for comparison.

Guaranteed Five Card Hand

The basic goal of the guaranteed five card hand game is for the player to choose five cards to form a hand that is listed on the payout schedule. The guaranteed five card hand game begins with the player placing a wager and then choosing the five locations on the grid that she believes, after all 52 cards are revealed, will have a listed hand. Then the controller randomly selects and reveals the cards for all 52 locations. Again, the random selection can occur at any time prior to being revealed. Alternatively, only the chosen locations are revealed. Payouts are based on how the hand formed from the cards revealed in the chosen locations compares to the payout schedule. In one embodiment, the player must use the five cards chosen, like in stud poker. In another embodiment, the game is played like draw poker, where the player is allowed to reject chosen locations and choose others to total five locations. If all the locations were previously revealed, then the cards are again randomly selected and revealed for all rejected and newly chosen locations, leaving out the rejected cards. If only the chosen locations are revealed, there is no need to select cards again, but to merely reveal the newly-chosen locations. It is also contemplated that this individual game may be played as a secondary bonus to another game.

Guaranteed Seven Card Hand

The guaranteed seven card hand game is very similar to the guaranteed five card hand game. The guaranteed seven card hand game begins with the player placing a wager and then choosing the seven locations on the grid that she believes, after all 52 cards are revealed, will have a listed hand. Then the controller randomly selects and reveals the cards for all 52 locations. Optionally, only the chosen locations are revealed. Payouts are based on how the hand formed from the cards revealed in the chosen locations compares to the payout schedule. The same two embodiments as the guaranteed five card hand game, the stud-poker-like embodiment and the draw-poker-like embodiment, are contemplated for the guaranteed seven card hand game. Like the guaranteed five card hand game, it is also contemplated that this individual game may be played as a secondary bonus to another game.

The Combination Game

In the combination game of the present invention, two, three, or all four of the above-described individual games, or rounds, are combined into a single game.

Before game play begins, the house determines the exact rules of the combination game, including such items as which individual game is played in each round, the number of locations to match, how many cards are in a hand, the payout schedule, and any other rules necessary to playing the game. As indicated above, it is preferred that the order of rounds is the five location match game, the seven location match game, the guaranteed five card hand game, and the guaranteed seven card hand game. The present invention also contemplates that the individual games may be played in any order. In the remainder of this description, the preferred order and poker rules for the individual games are assumed.

The game begins with the player choosing which rounds she will participate in, which locations to play for each round, and the amount to wager for each chosen round. The number of locations that are chosen depends upon which rounds are played and whether the same chosen locations must be played for all rounds or different locations may be played for each round. In a simple example, the player chooses only rounds one and three and then chooses five locations that are played for both rounds. In a more complicated example, the player chooses all four rounds and different locations for each round. How rounds and locations are chosen is described below.

The timing of the choices depends upon the manner in which the game is played. There are two basic forms. In the first, the timing is controlled by the players: the process of choosing is not over until all participating players have made their choices. In the second, the timing is controlled by a clock: each game begins at a fixed time, and all players participating in a game must have their choices made prior to that time.

Figure 2:
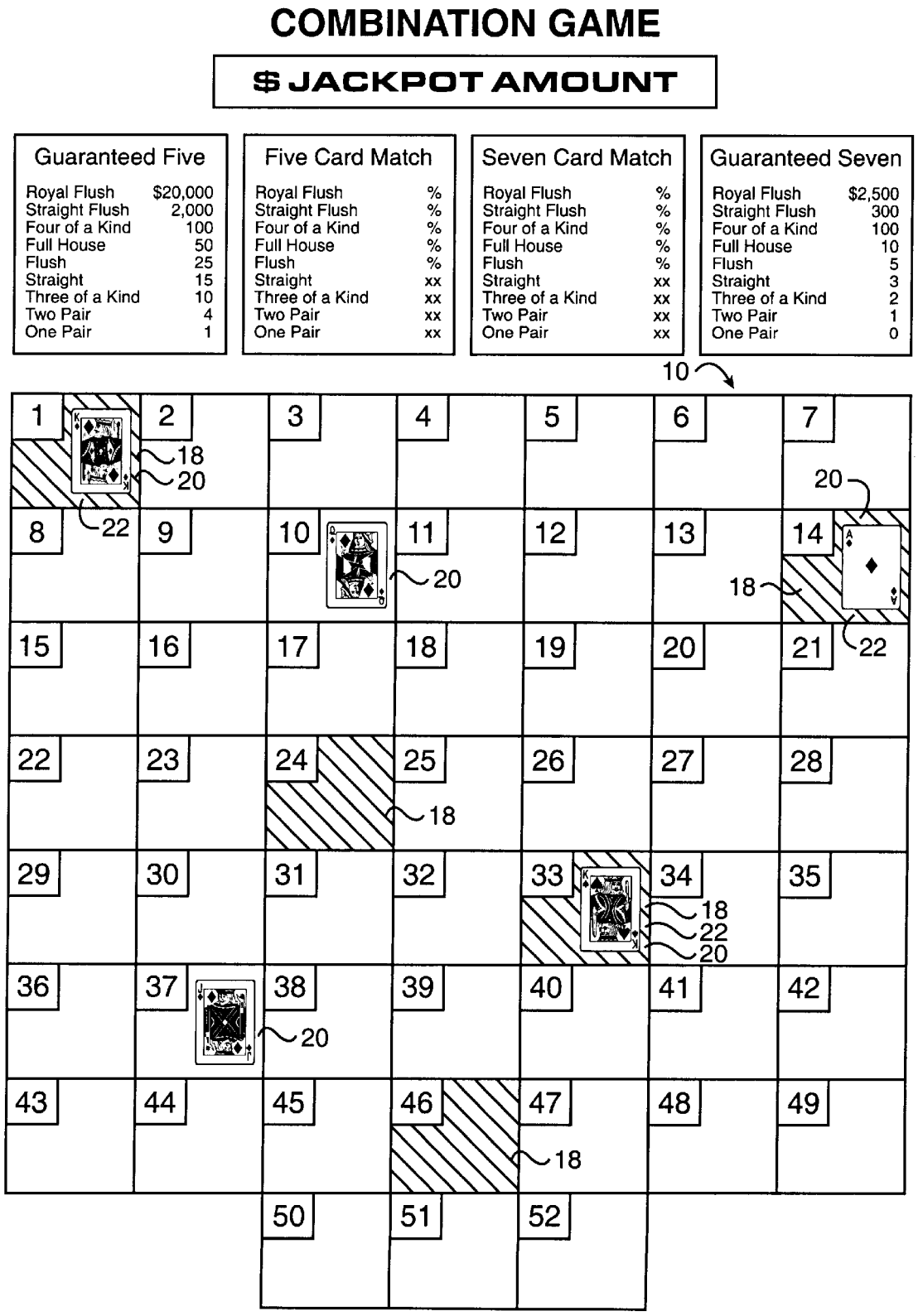
FIG. 2 is an example grid of the five location match game of the first round of the present invention.

At the appropriate time, the five location match game is initiated and, assuming that all player choices have been made, the five locations and the cards for those locations are randomly selected and revealed. The actual timing of when the cards are randomly selected is not important. Since the cards are not revealed to the players until the appropriate time during each round, the cards may be randomly selected at any time prior to being revealed. In the example grid 10 of FIG. 2, the player-chosen locations 18 are indicated by left-to-right diagonals and the randomly-selected locations 20 are indicated by revealed cards. Typically, if the grid 10 is intended to be viewed by more than one player, the player-chosen 18 locations are not shown on the grid. However, if the grid is intended to be viewed by only one player, the player-chosen locations 18 may be indicated in some manner, such as by a different colored background. Note that in the example of FIG. 2, there are three matched locations 22, that is, the player chose three locations that were randomly selected, and the hand formed by the matched locations 22 include one pair. At this time, the game is suspended and payouts based on the number of matched locations and/or the payout schedule for the resulting hand are made to the appropriate players. Alternatively, payouts are held until the end of the game, when payouts for all of the rounds are made at the same time.

Next, the seven location match game is initiated by randomly selecting and revealing two more cards. These two cards plus the five cards revealed for the five location match game are the seven cards used to determine matched locations. In FIG. 3, the new player-chosen locations 24 are indicated by right-to-left diagonals. Note that in the example of FIG. 3, there are now five matched locations and the hand formed by the matched locations includes two pairs. Like the first round, either the game is suspended and payouts made, or the payouts are held until the end of the game.

Next, the guaranteed five card hand game is initiated by randomly selecting and revealing the remainder of the cards, as in FIG. 4. The cards selected and revealed in the previous two rounds carry over to this round. Note that in the example of FIG. 4, the hand formed by the five player-chosen locations includes two pair. Alternatively, as described above with reference to the individual guaranteed five card hand game, only the cards of the player-chosen locations 18 are revealed. At this time, any draw-poker-type actions are initiated, if allowed by the rules. Again, either the game is suspended and payouts made, or the payouts are held until the end of the game.

Finally, the guaranteed seven card hand game is played, as in FIG. 5. The cards selected and revealed in the previous rounds carry over to this round. Note that in the. example of FIG. 5, the hand formed by the seven player-chosen locations includes a full house. Then payouts that have not yet been made, for both the guaranteed seven card hand game and the payouts from the previous rounds that were held until the end of the game, are made.

As indicated above, the appropriate cards are revealed at the beginning of each round, in progression as each game is played. It is also contemplated that all of the cards are revealed at the same time. The advantage to revealing cards in progression is that the suspense of the game is enhanced because of the extended time over which the game is played. The advantage to revealing all of the cards at once is that the game is over more quickly and more games can be played during a given period of time. Finally, the present invention contemplates a hybrid, that is for example, all of the cards for the first two rounds are revealed and then all of the cards for the last two rounds are revealed at a later time.

Playing Medium

The present invention contemplates that the game may be played on a variety of media, including scratch or pull-tab tickets and electronic media, such as public systems and stand-alone machines.

Figure 6:
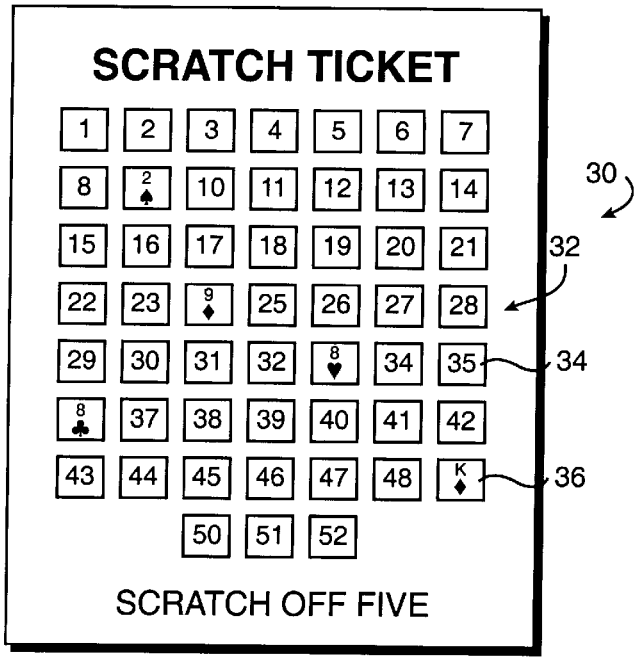
FIG. 6 shows a scratch ticket embodying the present invention.

With scratch tickets 30 or pull-tab tickets, as shown in FIG. 6, the grid 32 is printed on the ticket 30, where the random selection of cards for each location 34 is made prior to printing. The player makes her choices by scratching the chosen locations 36 and comparing the resulting hands to the payout schedule that is typically printed on the back of the ticket 30.

Figure 7:
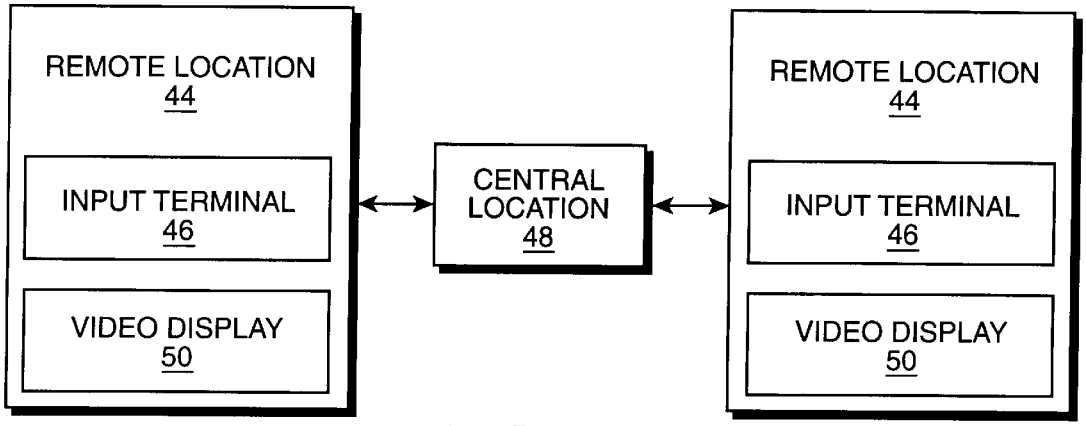
FIG. 7 is a block diagram of a public video system embodying the present invention.
Figure 8:
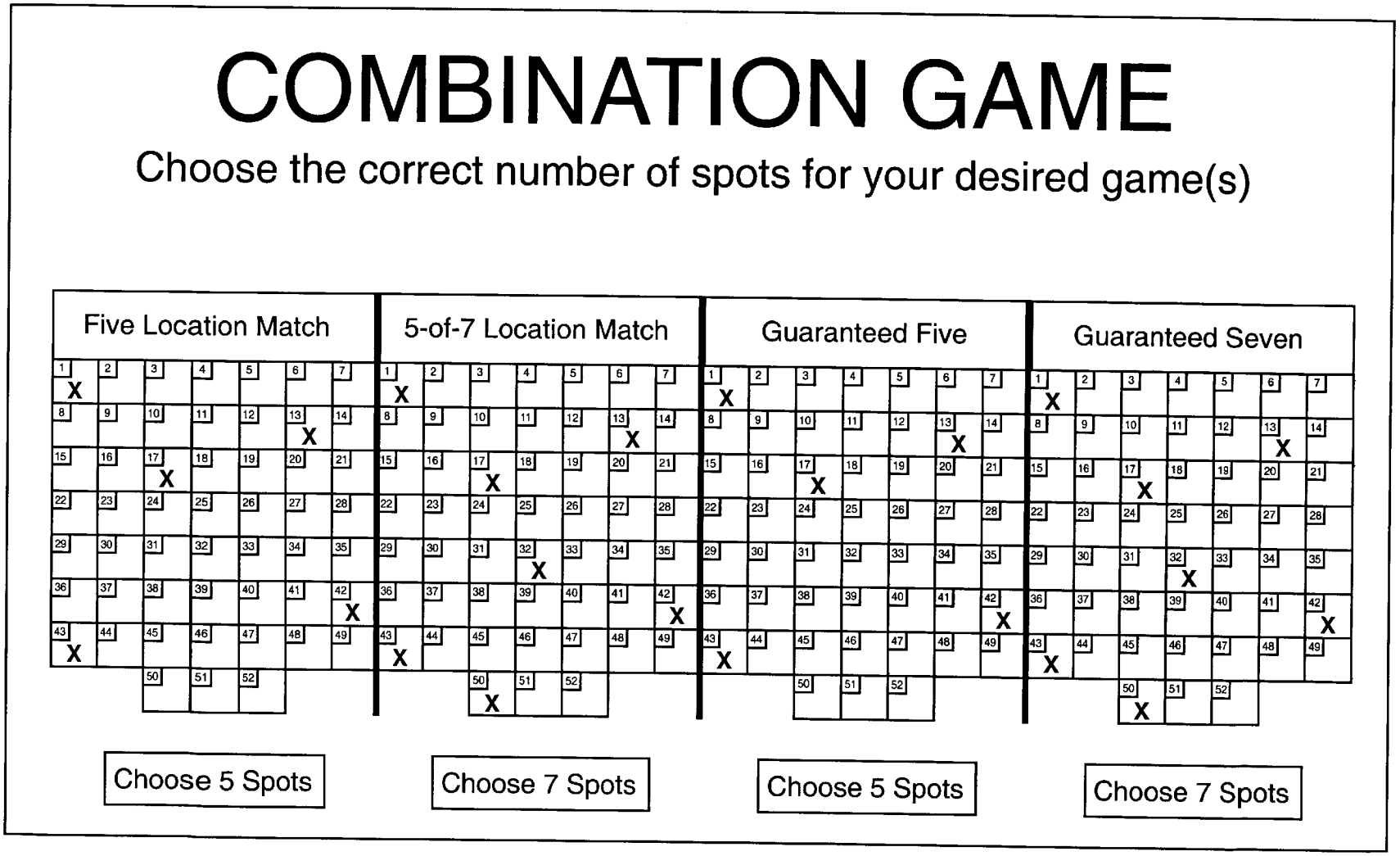
FIG. 8 is an example of a slip for choosing individual games and grid locations.

In public systems, a block diagram of which is shown in FIG. 7, players typically make their choices at remote locations 44 by marking slips of paper that are then scanned into a terminal 46 that sends the choices to a central location 48. Two examples of such a slip 40, 42 are shown in FIGS. 8 and 9. Alternatively, choices can be made by keys or touch screen. Alternatively, the player may request a "quick pick," where the system randomly chooses locations for the player. The player receives a receipt, such as a paper receipt, or other acknowledgement, such as an indication on a private terminal, indicating the locations chosen for each round. The grid is displayed on a video screen 50 or matrix of video screens visible to the players at the remote location 44 from information received from the central location 48.

Figure 10:
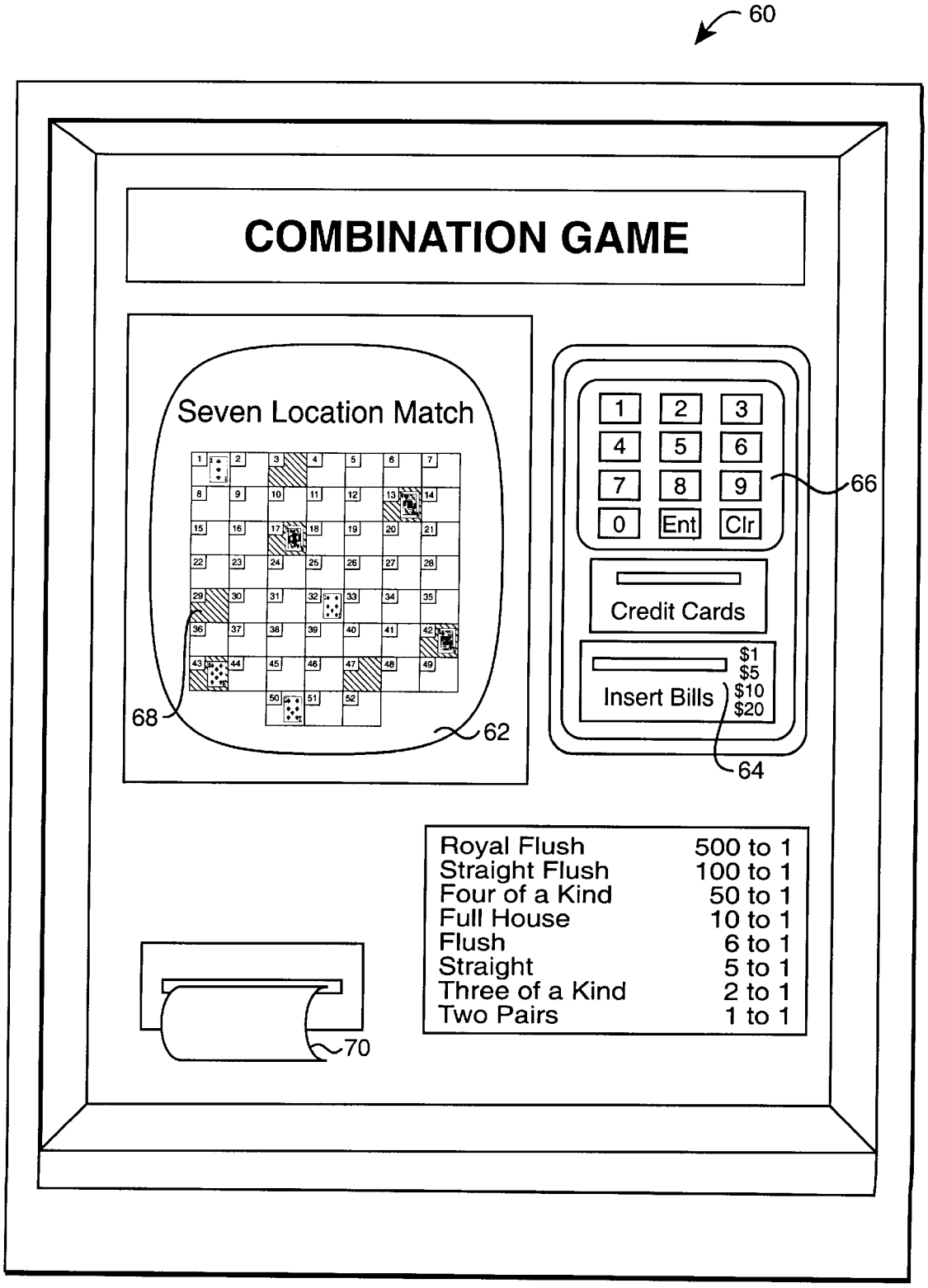
FIG. 10 is an example of a standalone machine embodying the present invention.

With standalone machines, an example of which is shown in FIG. 10, each player has her own terminal 60. An example is a video machine at a gaming establishment. The grid is displayed on the player's video screen 62 and the player's choices are made using keys, as at 66, or a touch screen. Wagers are inserted into the machine, as at 64. The chosen locations 68 are displayed on the grid in some manner, such as by using a different background color. Winning amounts may be printed on a voucher 70 for payment by a cashier or they may be paid in coins or other monetary tokens by the machine itself.

Alternatively, the standalone machine may be a personal computer on a network. Wagers can be made by debits to credit cards or debit cards or other cash equivalent, and payouts may be made by crediting credit or debit cards or other bank account.

The information transfer between the remote and central locations can occur on any communications system, including local-area and wide-area networks. In local-area networks, the remote locations and central location are in close proximity to each other, such as in a single building or building complex, and are typically wired directly together. In wide-area networks, there is generally no limitation to how far the locations are from each other. Communication typically occurs over private leased telephone lines or public lines such as Internet connections. In some cases, the communication is wireless. In other cases, communication is over television cables.

Thus it has been shown and described a multiple round card game of chance which satisfies the objects set forth above.

Since certain changes may be made in the present disclosure without departing from the scope of the present invention, it is intended that all matter described in the foregoing specification and shown in the accompanying drawings be interpreted as illustrative and not in a limiting sense.

What is claimed is:

1. A method of playing a card game with a set of cards, said method comprising the steps of:

(a) providing a grid having one card location for each card, a plurality of rounds that are played in part on said. grid, unique rules for each of said rounds, and a payout schedule for each of said rounds;

(b) randomly selecting a card for each of said card locations;

(c) allowing a player to choose to play at least one of said rounds and to place a wager for each of said chosen rounds;

(d) allowing said player to choose a predetermined number of said card locations for each of said chosen rounds;

(e) revealing said selected cards on said grid for a portion of said card locations according to said rules;

(f) forming a hand for each of said chosen rounds from said chosen locations according to said rules; and (g) paying a predetermined amount for each of said hands according to said payout schedule.

2. The method of playing a card game of claim 1 wherein said selected cards are revealed in progression for each of said rounds.

3. The method of playing a card game of claim 1 wherein said selected cards are revealed for all of said rounds at one time.

4. The method of playing a card game of claim 1 wherein all of said payouts are made after said selected cards are revealed for all of said rounds.

5. The method of playing a card game of claim 1 wherein said payouts for each of said rounds are made after said selected cards are revealed for said round.

6. The method of playing a card game of claim 1 wherein one of said rounds comprises randomly selecting a predetermined number of said locations and revealing said selected cards for said selected locations, determining matched locations as being those of said chosen locations that are the same as said selected locations, and including in said payout schedule payouts based on the number of said matched locations.

7. The method of playing a card game of claim 6 wherein said payout schedule includes payouts for hands formed from said selected cards from said matched locations.

8. The method of playing a card game of claim 7 wherein said predetermined number of chosen locations and said predetermined number of selected locations are five and wherein said payouts are based on five card poker hands.

9. The method of playing a card game of claim 7 wherein said predetermined number of chosen locations and said predetermined number of selected locations are seven and wherein said payouts are based on seven card poker hands.

10. The method of playing a card game of claim 1 wherein one of said rounds comprises randomly selecting a predetermined number of said locations and revealing said selected cards for said selected locations, determining matched locations as being those of said chosen locations that are the same as said selected locations, and including in said payout schedule payouts for hands formed from said selected cards from said matched locations.

11. The method of playing a card game of claim 10 wherein said predetermined number of chosen locations and said predetermined number of selected locations are five and wherein said payouts are based on five card poker hands.

12. The method of playing a card game of claim 10 wherein said predetermined number of chosen locations and said predetermined number of selected locations are seven and wherein said payouts are based on seven card poker hands.

13. The method of playing a card game of claim 1 wherein one of said rounds comprises revealing said selected cards for said chosen locations and including in said payout schedule payouts for hands formed from said selected cards from said chosen locations.

14. The method of playing a card game of claim 13 wherein said predetermined number of chosen locations is five and wherein said payouts are based on five card poker hands.

15. The method of playing a card game of claim 13 wherein said predetermined number of chosen locations is seven and wherein said payouts are based on seven card poker hands.

16. A method of playing a card game with a set of cards, said method comprising the steps of:

(a) providing a grid having one card location for each card, a plurality of rounds that are played in part on said grid, unique rules for each of said rounds, and a payout schedule for each of said rounds;

(b) randomly selecting a card for each of said card locations;

(c) allowing a player to choose to play at least one of said rounds and to place a wager for each of said chosen rounds;

(d) allowing said player to choose a predetermined number of said card locations for each of said chosen rounds;

(e) revealing said selected cards on said grid for a portion of said card locations according to said rules;

(f) forming a hand for each of said chosen rounds from said chosen locations according to said rules; and (g) paying a predetermined amount for each of said hands according to said payout schedule;

(h) a first of said rounds comprising randomly selecting a predetermined number of said locations and revealing said selected cards for said selected locations, determining matched locations as being those of said chosen locations that are the same as said selected locations, and including in said payout schedule payouts based on the number of said matched locations; and (i) a second of said rounds comprising revealing said selected cards for said chosen locations and including in said payout schedule payouts for hands formed from said selected cards from said chosen locations.

17. The method of playing a card game of claim 16 wherein said selected cards are revealed in progression for each of said rounds.

18. The method of playing a card game of claim 16 wherein said selected cards are revealed for all of said rounds at one time.

19. The method of playing a card game of claim 16 wherein all of said payouts are made after said selected cards are revealed for all of said rounds.

20. The method of playing a card game of claim 16 wherein said payouts for each of said rounds are made after said selected cards are revealed for said round.

21. The method of playing a card game of claim 16 wherein said payout schedule includes payouts for poker hands formed from said selected cards from said matched locations of first individual game.

22. A method of playing a card game with a set of cards, said method comprising the steps of:

(a) providing a grid having one card location for each card, first, second, third, and fourth rounds that are played in part on said grid, unique rules for each of said rounds, and a payout schedule for each of said rounds;

(b) randomly selecting a card for each of said card locations;

(c) allowing a player to choose to play at least one of said rounds and to place a wager for each of said chosen rounds;

(d) allowing said player to choose a predetermined number of card locations for each of said chosen rounds, including five of said card locations for said first round, seven of said card locations for said second round, five of said card locations for said third round, and seven of said card locations for said fourth round;

(e) selecting five card locations, revealing said selected cards on said grid for said selected five locations, and determining first matched locations for said first round as being those of said five chosen locations that are the same as said five selected locations;

(f) selecting two card locations different from said selected five locations, revealing said selected cards on said grid for said selected two locations, and determining second matched locations for said second round as being those of said seven chosen locations that are the same as said five selected locations and said two selected locations;

(g) forming a hand for said third round from said selected cards of said five chosen locations;

(h) forming a hand for said fourth round from said selected cards of said seven chosen locations; and (i) including in said payout schedule payouts based on the number of said first matched locations, the number of said second matched locations, said third round hand, and said fourth round hand.

23. The method of playing a card game of claim 22 wherein all of said payouts are made after said selected cards are revealed for all of said rounds.

24. The method of playing a card game of claim 22 wherein said payouts for each of said rounds are made after said selected cards are revealed for said round.

25. The method of playing a card game of claim 22 wherein a hand for said first round is formed from said selected cards of said first matched locations, and wherein said payout schedule includes payouts based on said first round hand.

26. The method of playing a card game of claim 22 wherein a hand for said second round is formed from said selected cards of said second matched locations, and wherein said payout schedule includes payouts based on said second round hand.

27. The method of playing a card game of claim 22 wherein said hands are poker hands.

* * * * *